US005200760A

United States Patent [19]

Ujihara et al.

[11] Patent Number: 5,200,760

[45] Date of Patent: Apr. 6, 1993

[54] THERMAL HEAD FOR A THERMAL PRINTER

[75] Inventors: Takashi Ujihara, Yamagata; Tsunehiro Tsukagoshi, Saitama, both of Japan

[73] Assignee: Tohoku Pioneer Electronic Corporation, Yamagata, Japan

[21] Appl. No.: 723,012

[22] Filed: Jun. 28, 1991

[30] Foreign Application Priority Data

Sep. 28, 1990 [JP] Japan ..... 2-259892
Jan. 21, 1991 [JP] Japan ..... 3-20558

[51] Int. Cl.[5] ..... B41J 2/335
[52] U.S. Cl. ..... 346/76 PH
[58] Field of Search ..... 346/76 PH, 1.1; 29/611

[56] References Cited

U.S. PATENT DOCUMENTS

| | | | |
|---|---|---|---|
| 3,781,983 | 1/1974 | Hiruma et al. | 29/611 |
| 3,950,200 | 4/1976 | Muramoto et al. | 156/89 |
| 4,636,812 | 1/1987 | Bakewell | 346/76 |
| 4,680,593 | 7/1987 | Takeno et al. | 346/76 PH |
| 4,978,972 | 12/1990 | Volpe, Jr. et al. | 346/76 PH |

FOREIGN PATENT DOCUMENTS

| | | | |
|---|---|---|---|
| 0019558 | 1/1985 | Japan | 346/76 PH |
| 0179269 | 9/1985 | Japan | 346/76 PH |
| 0040169 | 2/1986 | Japan | 346/76 PH |
| 0005859 | 1/1987 | Japan | 346/76 PH |
| 0083155 | 4/1987 | Japan | 346/76 PH |
| 0109664 | 5/1987 | Japan | 346/76 PH |

OTHER PUBLICATIONS

Patent Abstract of Japanese Patent Reference No. 59-142168 filed Aug. 15, 1984.

Patent Abstract of Japanese Patent Reference No. 61-49859 filed Mar. 11, 1986.

*Primary Examiner*—Benjamin R. Fuller
*Assistant Examiner*—N. Le
*Attorney, Agent, or Firm*—Nikaido, Marmelstein, Murray & Oram

[57] ABSTRACT

An insulator substrate is held by a supporting member in an upright position. A plurality of heating members are formed on a top face of the substrate. A plurality of individual conductive patterns and a common electrode are provided on the substrate to be connected to the heating members so as to supply a current to each heating member.

5 Claims, 8 Drawing Sheets

THERMAL HEAD FOR A THERMAL PRINTER

BACKGROUND OF THE INVENTION

The present invention relates to a thermal head for a thermal printer used in instruments such as a facsimile receiver and a printer.

FIG. 1 shows a conventional thermal head for a facsimile receiver. The thermal head has a substrate 51 on which conductive patterns, thin heater films, and anti-wear film are layered. Integrated circuits 52 coated with a cover 56 are mounted on the substrate 51. A platen 54 is provided to press heat-sensitive recording paper 53 against the substrate 51 for printing dots on the paper. On the underside of the substrate 51, a radiator plate 55 is attached, and a circuit board 57 is mounted on the substrate 51.

The substrate 51 is made of ceramic, because the substrate is subjected to high temperature when the conductive patterns and the heater films are formed thereon and heated at printing. However, since the ceramic substrate has a large heat capacity and a low heat conductivity, a large electric power is required for heating necessary sections of the substrate to a desired temperature.

Furthermore, in order to prevent the thermal deformation of the substrate, the platen 54 is pressed against the substrate at a large force, for example 4 kg/cm$^2$. To feed the heat-sensitive paper 53 between the platen 54 and the substrate, a driving motor for a paper feeder must have a large power.

SUMMARY OF THE INVENTION

An object of the present invention is to provide a thermal head which may solve the above described problems.

Another object of the invention is to provide a method for effectively manufacturing a thermal head.

The thermal head of the present invention is characterized in that an insulator substrate is held by a supporting member in an upright position.

According to the present invention, there is provided a thermal head for a thermal printer comprising, an insulator substrate, a supporting member supporting the substrate in an upright position, a plurality of heating members provided on a top face of the substrate, and a plurality of individual conductive patterns and a common electrode provided on the substrate to be connected to the heating members so as to supply a current to each heating member.

In an aspect of the invention, the thermal head further comprises integrated circuits mounted on the substrate for supplying a current to each individual conductive pattern, and a printed circuit formed on the substrate for distributing a current to each integrated circuit.

In another aspect, the individual patterns are formed on one of vertical sides of the substrate, and the common electrode and the supporting member are provided on the other side of the substrate.

In further aspect of the invention, the heating members, individual conductive patterns and common electrode are provided on one of sides of the substrate, the supporting member is attached to the other side of the substrate, and the substrate is bent at the heating members on a top portion of the supporting member.

The method for manufacturing a thermal head for a thermal printer is characterized by forming a plurality of individual conductive patterns on one of sides of an insulator substrate, forming a common electrode on the same side of substrate as the conductive patterns, forming a plurality of heating members on the substrate, each of which is connected to the corresponding individual conductive pattern and to the common electrode, bending the substrate at the heating substrate, fixing the substrate to a supporting member at the other side of the substrate.

The other objects and features of this invention will become understood from the following description with reference to the accompanying drawings.

DETAILED DESCRIPTION OF THE PREFERRED EMBODIMENTS

Figure 1:
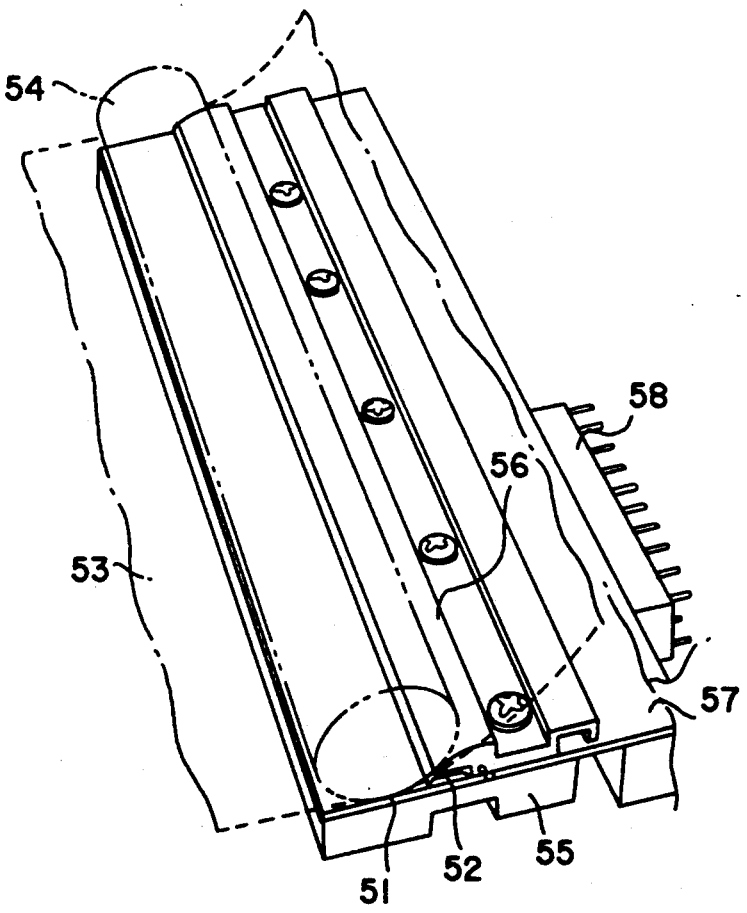
FIG.1 PRIOR ART
FIG. 1 is a perspective view of a conventional thermal head.
Figure 2:
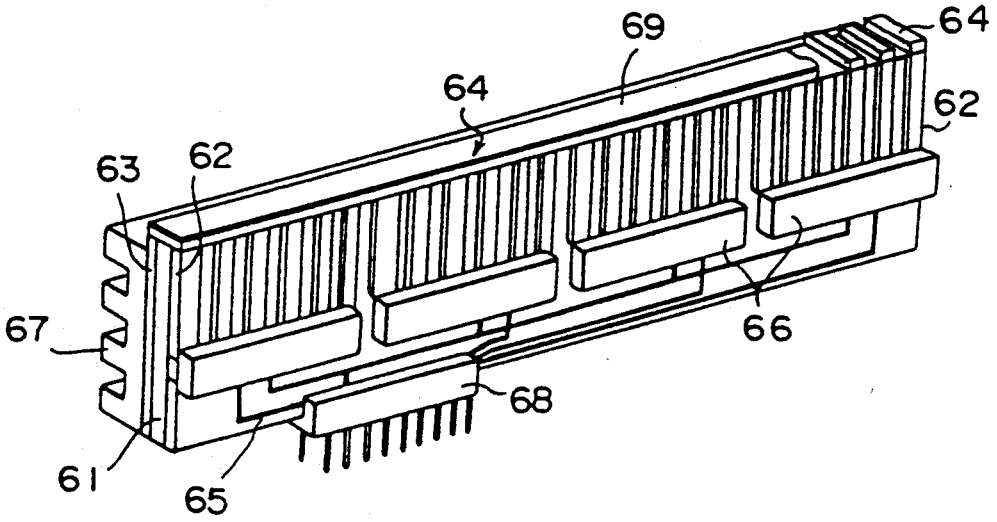
FIG. 2 is a perspective view showing a first embodiment of the present invention.

Referring to FIG. 2, the thermal head of the present invention comprises an insulator substrate 61 made of heat-resistant resin.

The substrate 61 is in the form of an elongated plate and in an upright position. On one of vertical sides of the substrate 61, a plurality of individual conductive patterns 62 are provided, and a common electrode film 63 of thin copper film is formed on the other vertical side. A plurality of heating members made of resistance material are formed on the longitudinal end face of the substrate 61. Each heating member 64 is connected to the corresponding conductive pattern 62 and to the common electrode film 63. The heating members 64 are coated with a cover 69 of anti-wear material.

A printed circuit 65, integrated circuits 66 and terminals 68 connected to a source and a controller are provided at a lower portion of the substrate 61. The printed circuit 65 serves to distribute a current to the integrated circuits 66.

The substrate 61 is made of heat-resistant resin having a good insulation quality such as polyimide resin and Teflon which are resistible to a high temperature of about 300° C. without thermally deforming.

The conductive pattern 62 and the common electrode film 63 are formed by a proper method such as sputtering.

A heat radiating member 67 made of metal having a good heat conductivity such as aluminum is attached on the common electrode film 63. The heat radiating member 67 serves as a supporting member for the substrate 61.

Figure 3:
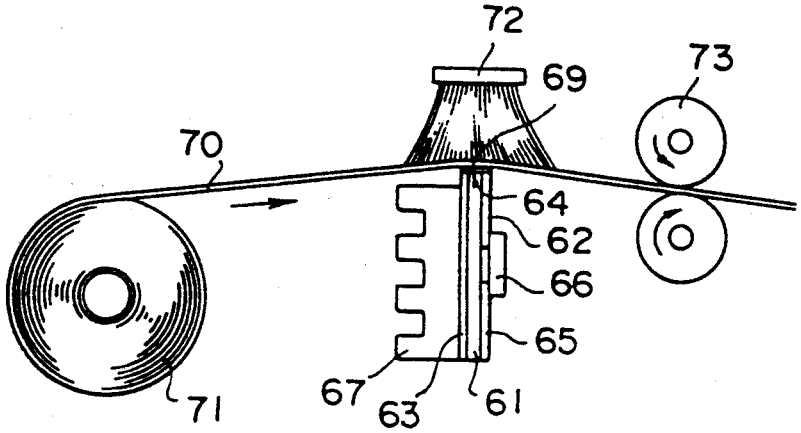
FIG. 3 is a side view of the thermal printer of FIG. 2.

Referring to FIG. 3 showing a printing state, heat-sensitive recording paper 70 is pressed against the cover 69 on the heating members 64 by a brush 72 at a low pressure, and fed by feed rolls 73 from a paper roll 71. The paper 70 is heated by the heating members 64, and dots according to the heating members 64 are printed on the paper. The brush 72 acts also to prevent the generation of static. The paper 70 is equally pressed on the cover 69 by the brush 72, so that a uniform printing can be obtained. Since the paper is pressed on the thermal head at a low pressure, power consumption is small. The top face of the vertically positioned substrate is hardly thermally deformed. Therefore, printings having high quality can be produced.

Figure 4:
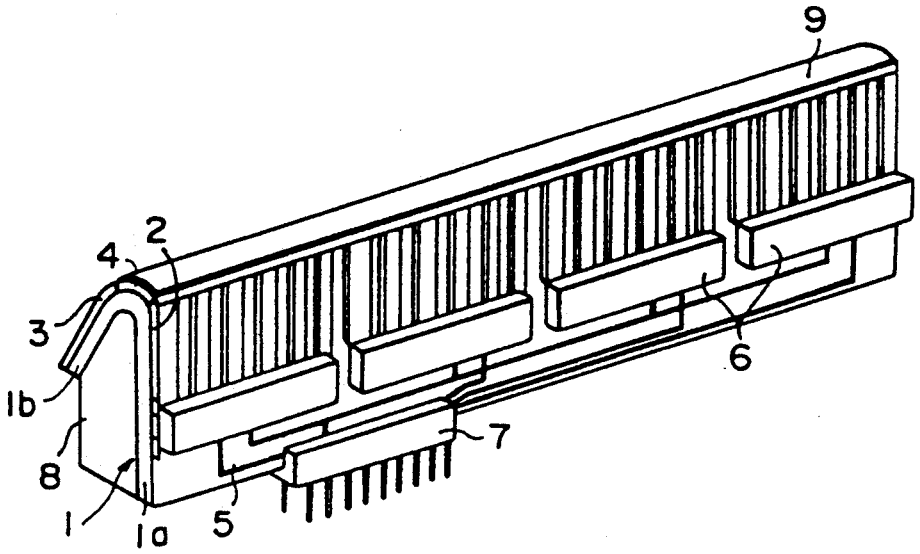
FIG. 4 is a perspective view of a second embodiment of the present invention.

Referring to FIG. 4, showing the second embodiment, the thermal head comprises a support 8 having an inverted U-shaped top portion, and an insulator substrate 1 made of heat-resistant resin mounted on the support 8. The support 8 is made of a ceramic sheet or metal sheet. the substrate 1 has a vertical side 1*a* and an inclined side 1*b* in accordance with the configuration of the support. The support 8 serves further as a radiator and a reinforcement member for the substrate 1.

On the vertical side 1*a*, a plurality of individual conductive patterns 2 are provided, and a common electrode film 3 of thin copper film is formed on the inclined side 1*b*. A plurality of heating members 4 are disposed between the conductive pattern 2 and the common electrode film 3. Each of the heating member is electrically connected to the corresponding conductive pattern 2 and the common electrode film 3. The heating members 4 are coated with a cover 9 of anti-wear material.

On the vertical side 1*a*, a printed circuit 5, integrated circuits 6 and terminals 7 connected to a source and a controller are provided at a lower portion thereof.

Describing in detail, the substrate 1 has a thin thickness less than 100 μm, preferably 25 to 50 μm if it does not break when bent.

The conductive pattern 2 and the common electrode film 3 are formed by a proper method such as sputtering and chemical vapor deposition. The conductive pattern 2 has a thickness of 1 μm to 30 μm.

Figure 5A:
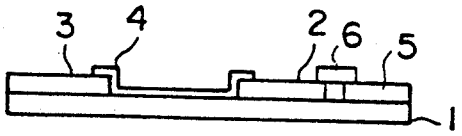
FIGS. 5*a* to 5*d* are side views showing the manufacturing of the second embodiment.
Figure 5B:
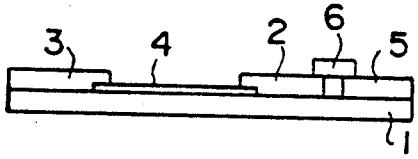

The heating member 4 is formed on the resin substrate 1 in the same method as the conductive pattern 2 as shown in FIGS. 5*a* and 5*b*. The thickness of the heating member 4 is 0.1 to 10 μm.

Figure 5C:
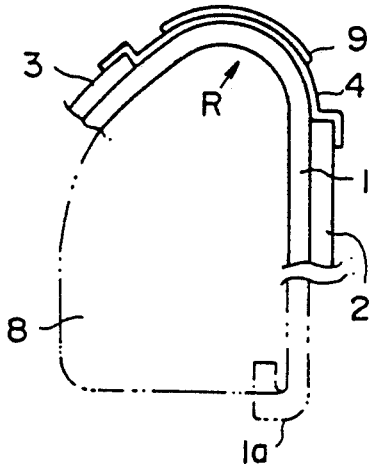
Figure 5D:
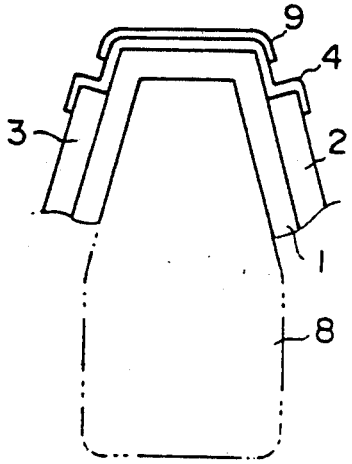
Figure 6:
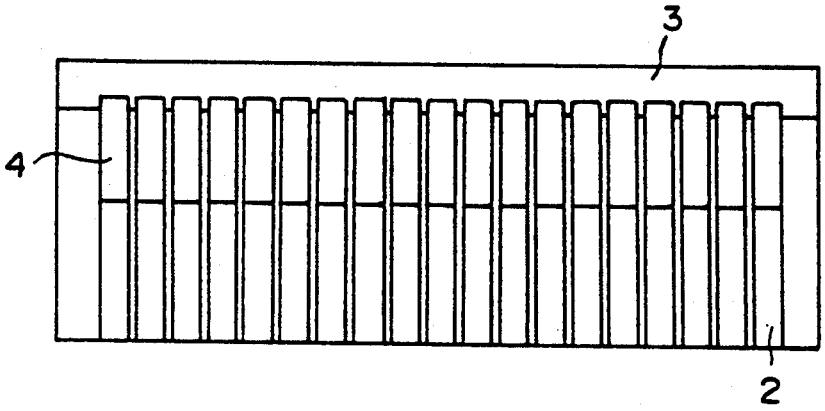
FIG. 6 is a plan view of a part of FIG. 5*a;*

The cover 9 is made of anti-wear material such as tantalum oxide ($Ta_2O_5$) and formed in the same manner as the conductive pattern 2. The cover 9 may be provided for covering a part of the heating member 4 as shown in FIGS. 5*c* and 5*d*. The printed circuit 5 is printed on the substrate at a lower portion thereof and serves as a distributor circuit.

The integrated circuits (IC) 6 are connected to the conductive patterns 2 and the printed circuit 5 by a proper method such as an wire bonding. The conductive patterns 2, integrated circuits 6 and printed circuit 5 are coated with resin (not shown).

The assembled substrate unit is bent into an inverted U-shape and secured to the support 8 with adhesive at the inner side thereof, so that the heating member 4 is mounted on the round top of the support. The radius R of curvature of the round top portion of the substrate 1 having the heating member 4 is preferably 0.1 to 1.00 mm. Since the heat-sensitive paper contacts with the round top of the heating member 4 during the printing, trouble such as jamming of paper in the machine does not occur.

FIG. 5*c* shows the thermal head made by another method. After the conductive pattern 2 and the common electrode 3 are formed on the substrate 1, the substrate is bent at a top portion between the pattern 2 and the electrode 3 and fixed to the support 8. Thereafter, the heating member 4 is formed on the substrate 1, partially overlayed on the pattern 2 and the electrode 3. Thus, stress does not occur in the heating member 4, which will occur when the member 4 is bent as described above. An end 1*a* of the substrate 1 is bent and engaged in a hole formed in the support 8, thereby ensuring the adhesion of the substrate to the support.

Figure 7:
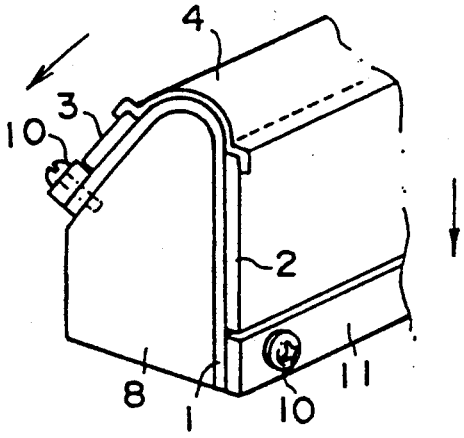
FIG. 7 is a perspective view of a modification of the second embodiment.

Referring to FIG. 7, the substrate 1 is mechanically secured to the support 8 by screws 10, interposing a reinforcement 11.

Figure 8:
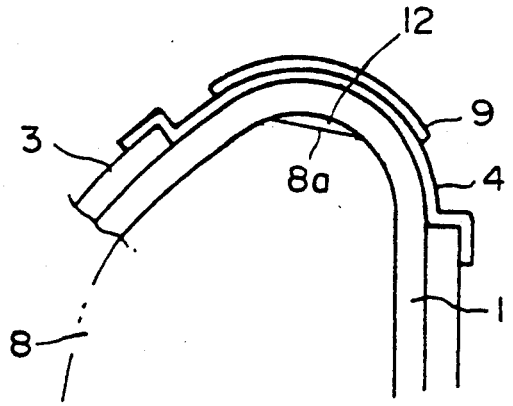
FIG. 8 is a side view of a third embodiment of the present invention.

FIG. 8 shows the third embodiment of the present invention. A flat portion 8*a* is provided on the top of the support, so that a space 12 is formed between the substrate 1 and the support 8. The space 12 serves as an insulator layer for the substrate. Consequently, the heat capacity of a top portion of the substrate 1 reduces, and hence the heat generated in the heating member 4 is effectively used for elevating the temperature of the member 4. Thus, the heating member 4 is operated at a low power consumption. Furthermore, clear printing can be obtained at a high speed.

The thickness of the space 12 is, for example, 500 μm. The space 12 can be formed by other methods, for example, by bending the resin substrate 1 at a larger radius of curvature than the support 8, or by securing the substrate 1 on the support without applying an adhesive on the top of the support so as to make vacant.

Figure 9:
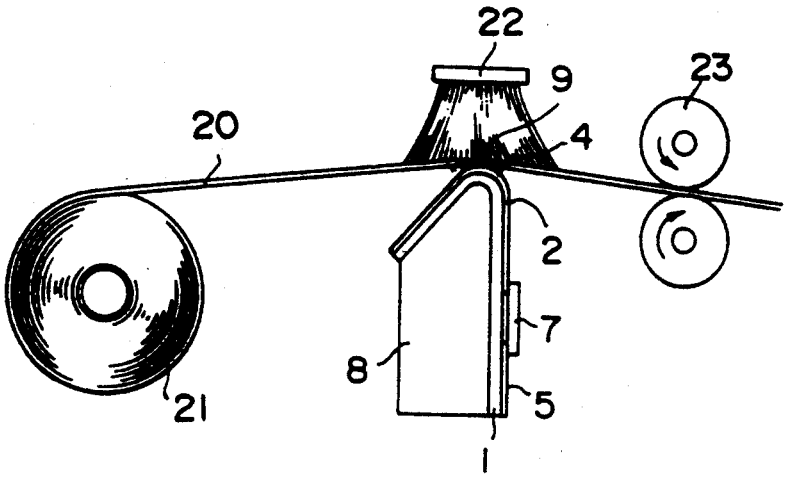
FIG. 9 is a side view of a printing state of the thermal printer of the second embodiment.

Referring to FIG. 9 showing a printing state, heat-sensitive recording paper 20 is pressed against the cover 9 on the heating member 4 by a brush 22 at a low pressure, and fed by feed rolls 23 from a paper roll 21. The paper 20 is heated by the heating member 4, and dots are printed on the paper. The curved heating member is hardly thermally deformed.

Figure 10:
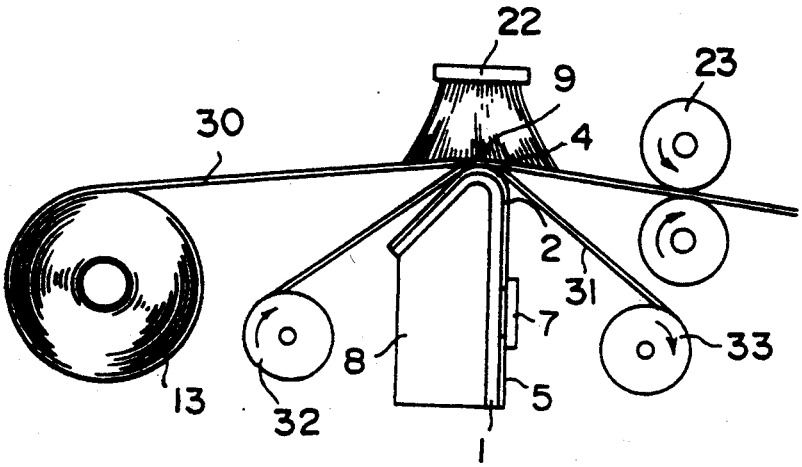
FIG. 10 is a side view showing another printing state.

FIG. 10 shows another use of the thermal head of the present invention. The printer uses ordinary paper 30 fed from a paper roll 13 and an inked ribbon 31 fed from a supply reel 32 to a take-up reel 33. The inked ribbon is heated in a pattern dependent on the dots in the heating member, and heated ink is transferred to the paper 30.

EXAMPLE 1

The polyimide resin sheet having a thickness of 45 μm was used as the resin substrate 1. The conductive pattern 2, the common electrode 3 and the printed circuit 5 were formed by plating copper with a thickness of 30 μm. The heating member 4 having a thickness of 0.2 μm is formed in the structure of FIG. 5*a* by sputtering a mixture of tantalum.

The ICs 6 are connected to the conductive pattern 2 and the printed circuit 5. The assembled substrate unit is bent at the heating member at the radius of curvature so that the heating member may contact with the paper in the length range of 0.13 mm. The inner side of the resin substrate 1 adhered to the support with an adhesive of epoxy resin.

The thermal head was used in the manner as described in FIG. 9, and clear printing was obtained. Although the temperature of the dots by the heating members rised up to 280° C., the temperature of the resin substrate was below 50° C. This is caused by the radiation effect of the support 8. Since the paper slided on the round top of the cover 9, there were not found defects of the paper such as a nap of the surface of the paper. The conductive patterns 2, the heating member 4 were not damaged in spite of use for a long term.

EXAMPLE 2

The resin substrate 1 made in the same manner as the Example 1 was used. The substrate 1 was attached to the support 8 with the space 12 having a thickness of about 100 μm between the substrate and the support 8.

Figure 11:
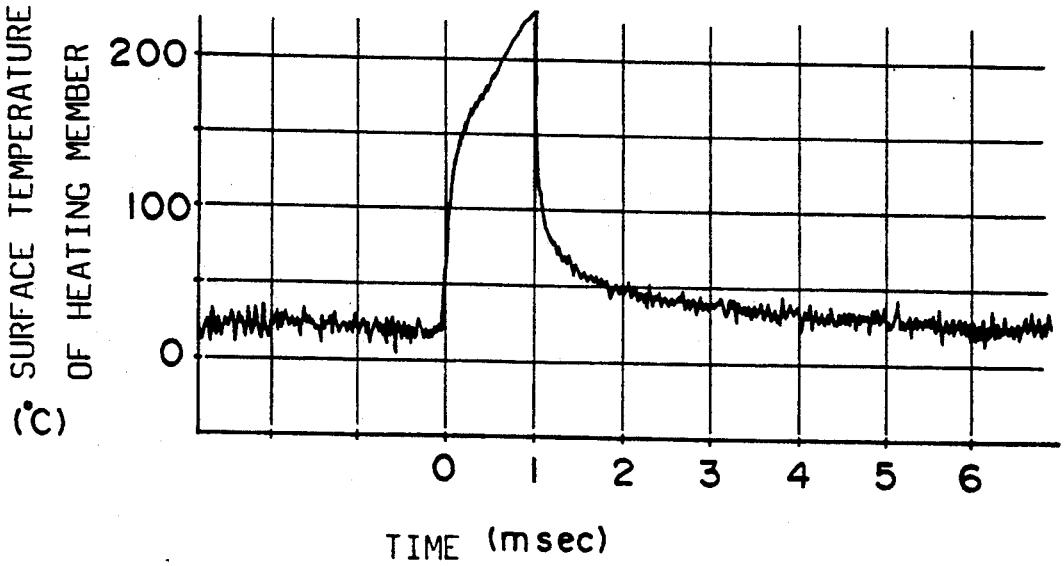
FIG. 11 is a graph showing heat response of the third embodiment.

At printing, power of 0.1 W per 1 msec. was supplied to the heating member 4. The surface temperature of the heating member 4 changed as shown in FIG. 11. Namely, the temperature rose steeply immediately after the power supply over 200° C. which was necessary temperature for the printing. The temperature rapidly lowered below 100° C. when the power stopped. Such a rapid temperature change is caused by a small thermal capacity of the heating member 4 dependent on the space 12.

On the other hand, the temperature of the substrate 1 was kept below 50° C., even if the power was continuously supplied. This is caused by the fact that the heat from the heating member 4 is not directly transmitted to the substrate and radiated to the support 8 passing through the common electrode 3.

Figure 12:
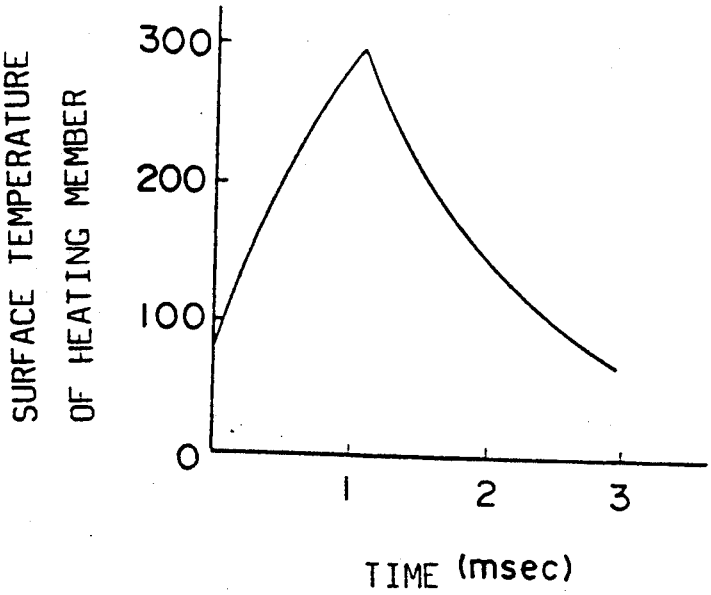
FIG. 12 is a graph showing heat response of the conventional printer of FIG. 1.

FIG. 12 shows a temperature change of the heating member of the conventional printer. It was necessary to supply the power of 0.56 W per 1 msec. in order to raise the temperature over 200° C. The elevated temperature slowly reduced as shown in the graph.

Thus, it will be seen that the thermal head of the present invention operates at a small power and produce a printing having a high quantity at a high speed with a small power consumption.

While the presently preferred embodiments of the present invention have been shown and described, it is to be understood that this disclosure is for the purpose of illustration and that various changes and modifications may be made without departing from the scope of the invention as set forth in the appended claims.

What is claimed is:

1. A thermal head for a thermal printer comprising:

an insulator substrate made of heat resistant resin and having an end face;

a supporting member supporting said substrate in an upright position;

a plurality of heating members attached to the end face of said substrate; and a plurality of individual conductive patterns and a common electrode attached to respective sides of said substrate, and connected to said heating members so as to supply a current to each of said heating members, said supporting member having a rounded top portion, wherein said heating members, said individual conductive patterns and said common electrode are provided on one side of said substrate, said supporting member is attached to another side of said substrate, and said substrate is bent at a location of said heating members over the rounded top portion of said supporting member, and said substrate being separated from said supporting member at the top portion thereof, thereby forming a space between said substrate and the top portion.

2. The thermal head according to claim 1, further comprising:

integrated circuits mounted on said substrate for supplying a current to each of said individual conductive patterns; and a printed circuit formed on said substrate for distributing a current to each of said integrated circuits.

3. The thermal head according to claim 1, wherein said individual conductive patterns are formed on a vertical side of the substrate, and said common electrode is formed on another side of the substrate.

4. A method for manufacturing a thermal head for a thermal printer comprising:

forming a plurality of individual conductive patterns on one side of an insulator substrate;

forming a common electrode on said one side of the substrate;

forming a plurality of heating members on said one side of the substrate, said heating members being disposed between said conductive patterns and said common electrode, wherein each of said heating members is connected to a respective individual conductive pattern and to the common electrode;

bending the substrate at a location of the heating elements; and fixing the substrate to a supporting member at another side of the substrate, wherein said supporting member has a rounded top portion and the substrate is bent over said rounded top portion of the supporting member, said step of fixing the substrate including the step of forming the substrate so as to be separate from the supporting member at the top portion whereby a space is formed between the substrate and the top portion.

5. A method for manufacturing a thermal head for a thermal printer comprising:

forming a plurality of individual conductive patterns on one side of an insulator substrate;

forming a common electrode on said one side of the substrate;

bending the substrate at a location between the individual conductive patterns and the common electrode;

fixing the substrate to a supporting member an another side of the substrate, wherein said supporting member has a rounded top portion and the substrate is bent over said rounded top portion of the supporting member, said step of fixing the substrate including the step of forming the substrate so as to be separate from the supporting member at the top portion whereby a space is formed between the substrate and the top portion; and forming a plurality of heating members on said one side of the substrate at said location where the substrate, said heating members being disposed between said conductive patterns and said common electrode, wherein each of said heating members is connected to a respective individual conductive pattern and to the common electrode.

* * * * *

UNITED STATES PATENT AND TRADEMARK OFFICE

CERTIFICATE OF CORRECTION

PATENT NO. : 5,200,760

DATED : April 6, 1993

INVENTOR(S) : Takashi UJIHARA et al

It is certified that error appears in the above-indentified patent and that said Letters Patent is hereby corrected as shown below:

On the title page, item [73], add --Pioneer Electronic Corporation, Tokyo, Japan--.

Signed and Sealed this

Thirty-first Day of May, 1994

Bruce Lehman

*Attest:*

BRUCE LEHMAN

*Attesting Officer*

*Commissioner of Patents and Trademarks*